United States Patent [19]

Statkus

[11] Patent Number: 4,505,378

[45] Date of Patent: Mar. 19, 1985

[54] CONVEYOR POCKET GRIPPING APPARATUS

[75] Inventor: George M. Statkus, Chicago, Ill.

[73] Assignee: Rockwell International Corporation, Pittsburgh, Pa.

[21] Appl. No.: 450,586

[22] Filed: Dec. 17, 1982

[51] Int. Cl.[3] ..... B65G 17/36; B65G 21/00

[52] U.S. Cl. ..... 198/710; 294/104; 271/204; 271/277

[58] Field of Search ..... 198/479, 656, 653, 695, 198/650; 271/277, 204, 205, 206, 82, 85; 294/104

[56] References Cited

U.S. PATENT DOCUMENTS

| | | | |
|---|---|---|---|
| 1,190,337 | 7/1916 | Stecher | 198/650 |
| 2,758,696 | 8/1956 | Eyler | 198/345 |
| 3,204,756 | 9/1965 | Lesch | 198/695 |
| 3,960,264 | 6/1976 | Carbine et al. | 198/650 |

FOREIGN PATENT DOCUMENTS

| | | | |
|---|---|---|---|
| 2518373 | 11/1975 | Fed. Rep. of Germany | 271/204 |

*Primary Examiner*—Joseph E. Valenza
*Assistant Examiner*—Douglas C. Voorhees

[57] ABSTRACT

A conveyor apparatus for successively receiving single newspapers being advanced by a conveyor loading device and advancing the same to a downstream location for additional processing. The apparatus includes an endless conveyor track having a conveyor chain that supports a multiplicity of pocket members in close proximity with the outer surface of the conveyor track and for movement about the extent of the track. The pocket members are equally spaced about the chain and each includes a pair of spaced spring biased arcuated fingers that are continually urged in a direction to engage and maintain a newspaper in a pocket when received from the loader. A cam controlled lever is operatively connected to the arcuated fingers and serves to control movement of the latter between positions for receiving and releasing a newspaper from a pocket and a position for maintaining one within a pocket.

4 Claims, 8 Drawing Figures

FIG. 5
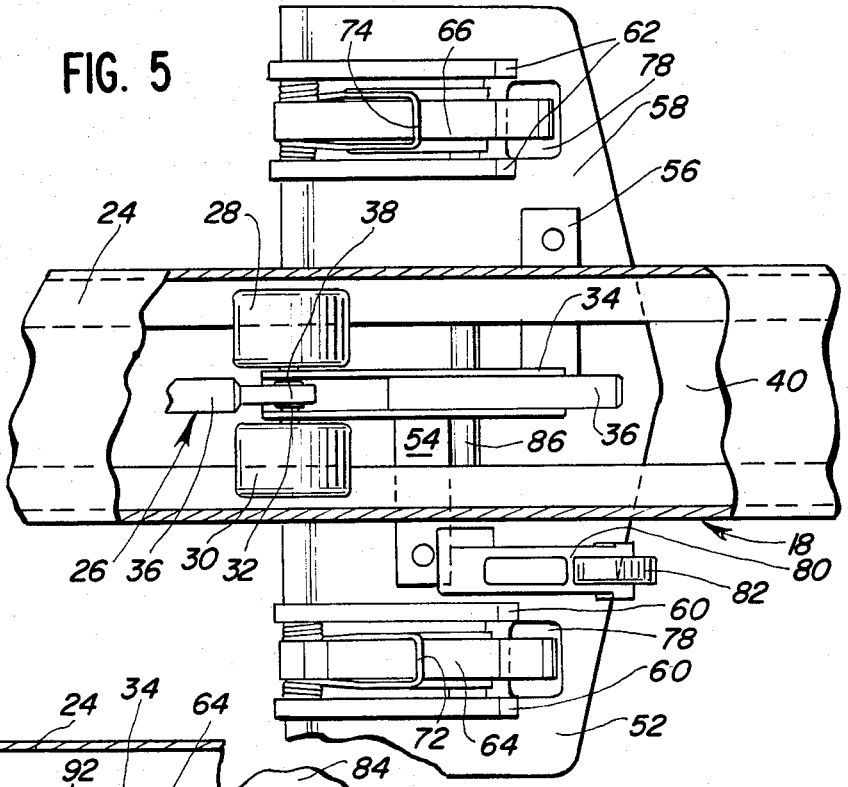
FIG. 6
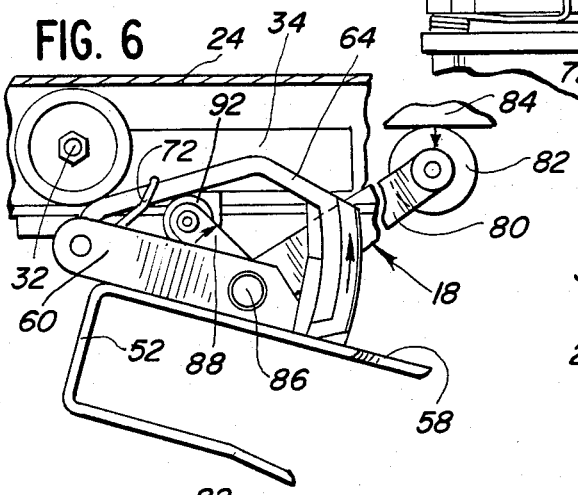
FIG. 7
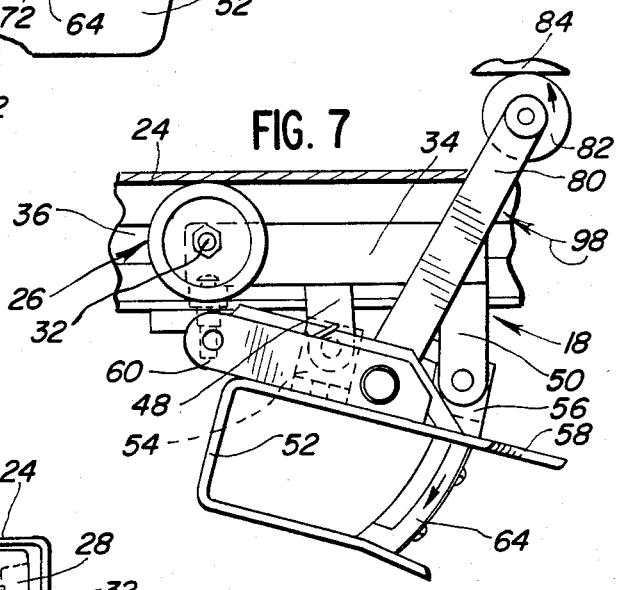
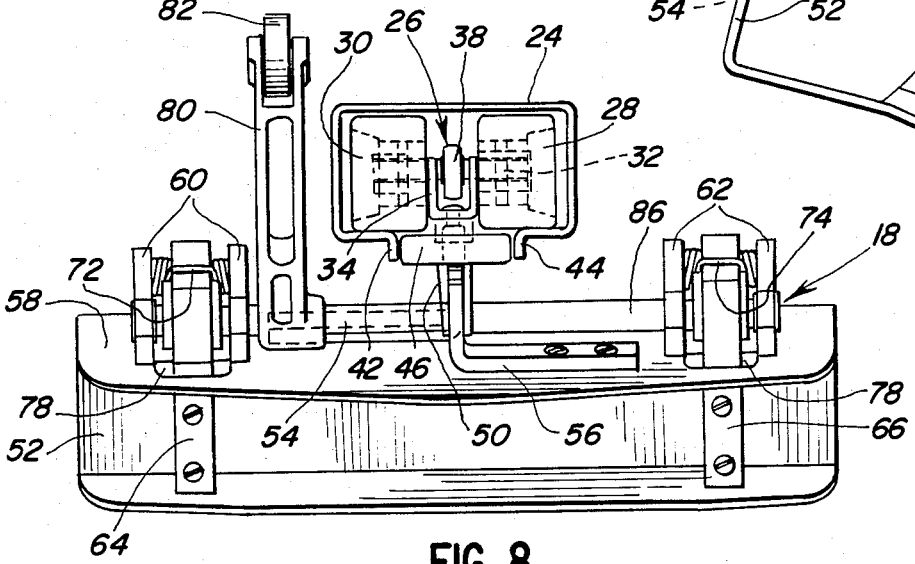
FIG. 8

CONVEYOR POCKET GRIPPING APPARATUS

BACKGROUND OF THE INVENTION

1. Field of the Invention.

The present invention pertains to an improved conveying apparatus for receiving folded newspapers from a conveyor loading device and transferring them to a pocket carousel type of endless conveyor. More particularly, the invention pertains to a conveying apparatus for independent control of each newspaper by receiving and gripping the cut edges of each newspaper and thence releasing them at a downstream location whereat the folded edges are received into the pockets of the carousel type endless conveyor and are in readiness for receiving additional processing.

2. Description of the Prior Art.

A number of U.S. patents show and describe conveying devices with gripping elements for holding newspapers and thence releasing them for reception by another conveyor and, for reference to the teachings of such disclosures, attention is hereby directed to U.S. Pat. Nos. 3,549,145 and 3,955,667.

SUMMARY OF THE INVENTION

The conveyor apparatus according to the invention includes an endless conveyor track having a conveyor chain mounted therein for travel about the extent of the track. A multiplicity of pocket members are operatively connected to the conveyor chain and are disposed in spaced and aligned relation about the exterior surface of the endless conveyor track about which they are caused to travel. Each pocket member is provided with a pair of spaced arcuated fingers that are spring biased in a direction to engage a newspaper when it is received from the conveyor loading device. Additionally, each pocket member includes a cam controlled actuating lever that is operatively connected to the arcuated fingers and is effective in causing movement of the fingers between positions for receiving and releasing a newspaper from a pocket member and a position for gripping and holding a newspaper in the pocket member.

It is a general object of the invention to provide an improved conveying apparatus for receiving and transferring newspapers to another conveyor for further processing.

A further and more specific object is to provide an improved conveying apparatus for receiving and gripping the cut edges of single newspapers and to transfer them to a location whereat they are released and their folded edges directed into the pockets of a carousel type endless conveyor.

These and other objects of the invention will become more fully apparent by reference to the appended claims and as the following detailed description proceeds in reference to the figures of drawing wherein:

BRIEF DESCRIPTION OF THE DRAWINGS

FIG. 5 is a top view of a pocket member showing its association with an endless conveyor track;

FIGS. 6 and 7 are views in side elevation of the elements shown in FIG. 5 showing the cam controlled actuating lever and its position for respectively effecting release and gripping of a newspaper by the arcuated fingers;

FIG. 8 is an end view of the pocket member and its associated elements shown in FIG. 7.

DESCRIPTION OF THE PREFERRED EMBODIMENT

Figure 1:
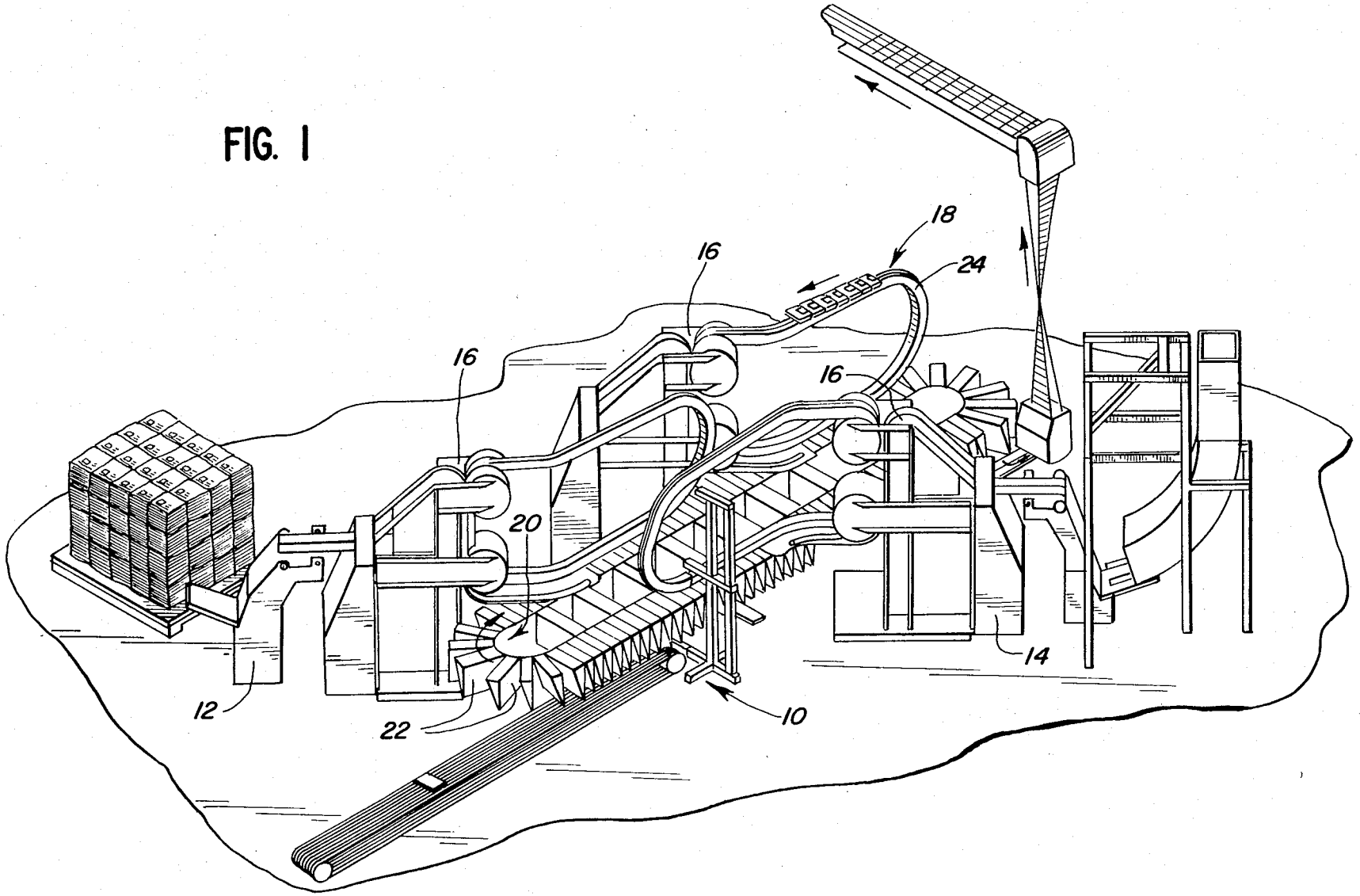
FIG. 1 is a perspective view of a newspaper assembler showing a conveyor apparatus according to the invention forming a part thereof.

Referring now to FIG. 1, the various mechanisms are shown that form a newspaper assembler that is identified generally by numeral 10. This assembler includes among its several mechanisms a pair of spaced stream makers 12 and 14, three conveyor loading apparatus 16 and the improved gripper conveyor apparatus according to the invention that is depicted generally by numeral 18 and which will be described in greater detail hereinafter.

A pocket carousel or endless conveyor with which the present invention is operatively associated is identified generally by numeral 20 and is provided with a multiplicity of pockets of V-shaped configuration that are identified in FIG. 1 by numeral 22.

The improved gripper conveyor apparatus 18, hereinafter referred to as "gripper conveyor", is provided with an endless conveyor track 24 (FIGS. 5–8) within which a conveyor chain identified generally by numeral 26 is disposed and driven by any suitable means (not shown) for travel about the extent of the track. This chain is formed by a multiplicity of pairs of roller members 28 and 30 (FIGS. 5–8) that are rotatably mounted on the ends of a pin member 32. The rollers 28 and 30 are disposed so as to define a space therebetween which provides a means for interconnecting the links of the chain with the pin member 32. These links are formed by an elongated U-shaped member 34 one end of which is provided with aligned openings through which the central portion of the pin member 32 extends. To complete each link, a bar member 36 is fixedly associated within the U-shaped member 34 in a manner whereby one end thereof extends beyond the member 34 and is provided with a rod end bearing 38 which is assembled on the pin member 32 intermediate the leg portions of the U-shaped member 34. It should be obvious that the rollers 28 and 30 guide the conveyor chain 26 during its travel about the extent of the conveyor track 24. As shown in FIG. 8, the cross-sectional configuration of the conveyor track 24 is generally rectangular but with a lower central opening 40 that extends about the entire extent of the track. As shown in FIG. 8, the sides of the central opening 40 define outwardly directed lip elements 42 and 44 and the opposed surfaces thereof are adapted to be engaged by a horizontally disposed center roller 46 that serves as an additional guide for the conveyor chan 26 as it travels around horizontal curved sections of the conveyor track 24.

Referring now to FIGS. 7 and 8, a pair of tandem link elements 48 and 50 of U-shaped configuration extend outwardly through opening 40 of the track from the underside of the U-shaped member 34 of the chain to which they are fixedly attached. These tandem link elements 48 and 50 serve to operatively connect conveyor pocket members 52 to the conveyor chain 26 by means of their outer ends being connected to L-shaped support members 54 and 56, respectively, that are fixed on the upper side of the pocket members 52 as shown in FIGS., 4, 5, 7 and 8. The upper side of pocket member 52 is identified by numeral 58 and is provided adjacent each end thereof with a pair of spaced and upwardly directed rib members with those on the left as shown in FIG. 8 being identified by numeral 60 and those on the right by numeral 62. Each pair of rib members 60 and 62 pivotally supports an arcuated finger which are identified by numerals 64 and 66, respectively. Pins 68 and 70 pivotally support the arcuated fingers 64 and 66 intermediate their rib members 60 and 62.

Figure 2:
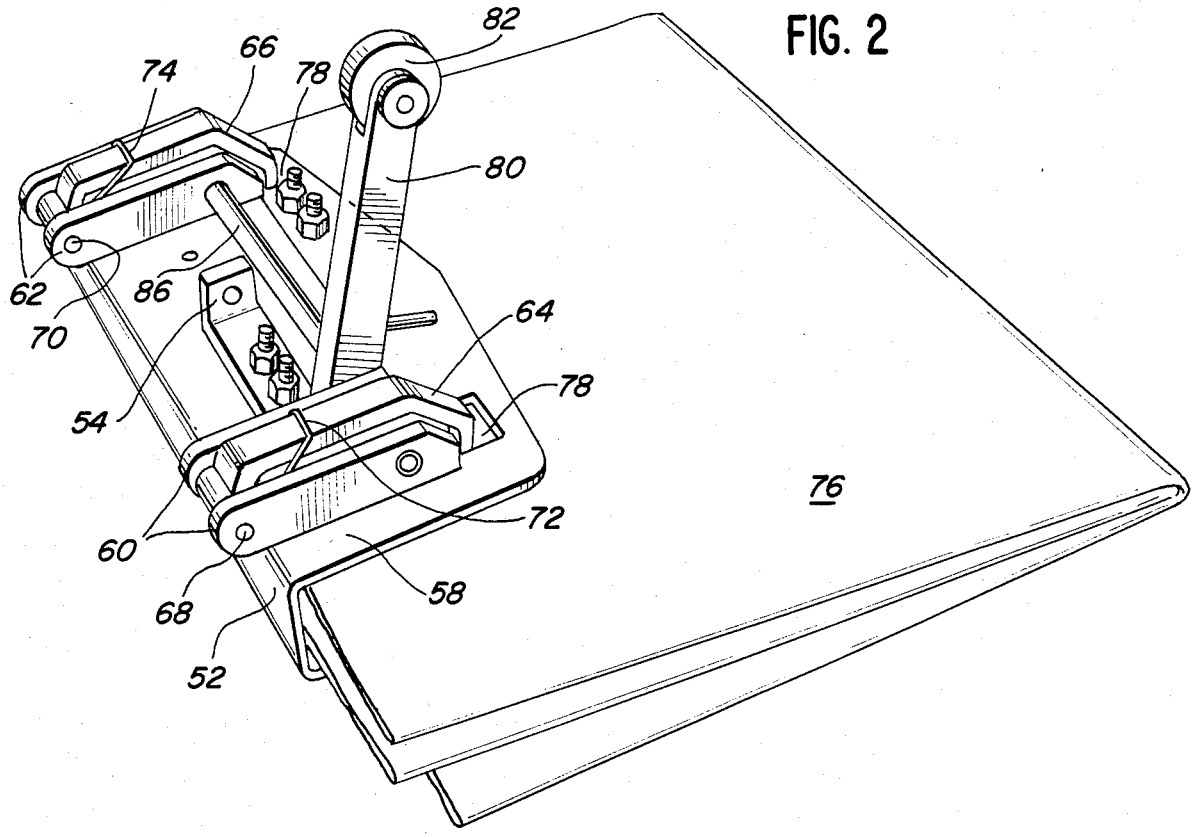
FIGS. 2, 3 and 4 are perspective views of the pocket members of the conveying apparatus showing the elements for gripping and releasing newspapers therefrom.
Figure 3:
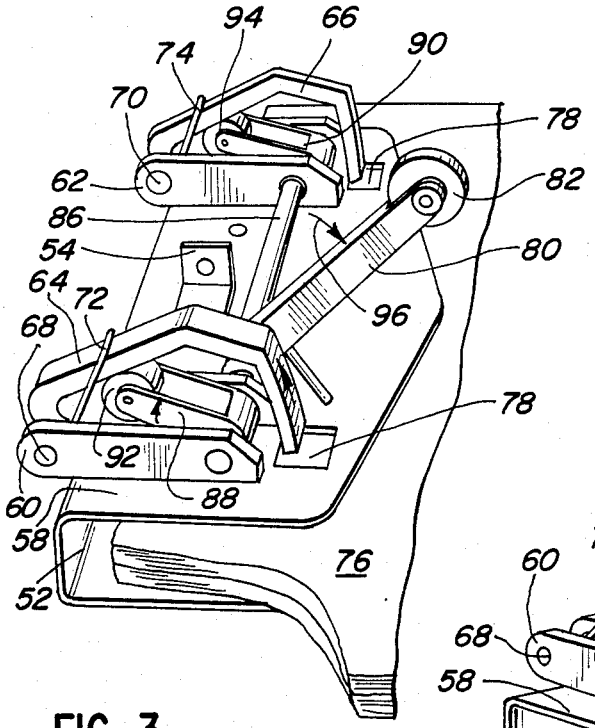
Figure 4:
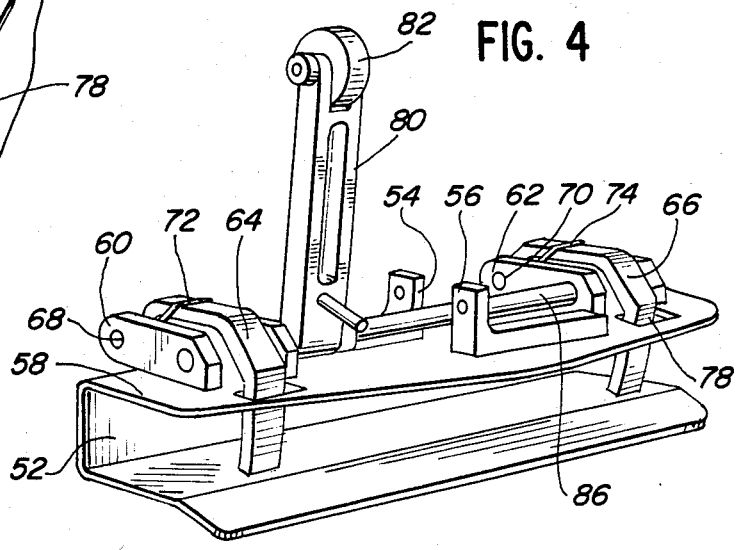

The arcuated fingers 64 and 66 are spring biased in a clockwise direction as viewed in FIGS. 2 and 3 by separate torsion type springs 72 and 74, respectively. FIGS. 2 and 3 show a folded newspaper 76 with the cut end portion located within the conveyor pocket 52. By a means yet to be described, the arcuated fingers 64 and 66 are held in the positions shown in FIGS. 3 and 6 until a newspaper 76 is received into the conveyor pocket 52. After receiving a newspaper, the arcuated fingers 64 and 66 are released and their torsion type springs 72 and 74, respectively, are effective in pivoting them in a direction whereby their free ends pass through openings 78 provided in the upper side 58 of the pocket member 56 so as to engage and maintain the newspaper within the pocket member 52.

The means for elevating the free ends of the arcuated fingers 64 and 66 for the purpose of releasing or receiving another newspaper into the pocket member 52 includes an actuating lever 80 having a cam follower roller 82 mounted on one end thereof which is disposed in operative association with a cam member 84 (FIGS. 6 and 7). The end of the actuating lever 80 opposite the cam follower 82 is fixed on a shaft 86 the ends of which are journaled in aligned openings provided in the pairs of rib members 60 and 62. As shown in FIG. 3, the portions of shaft 86 traversing the distance between each pair of rib members 60 and 62 has one end of a finger fixed thereon which are identified by numerals 88 and 90, respectively. The opposite end of finger 88 has a roller 92 mounted thereon and finger 90 is provided with a roller 94. Rollers 92 and 94 are in frictional engagement with the underside of their respective arcuated fingers 64 and 66.

Movement of the actuating lever 80 in the direction of the indicating arrow 96 in FIG. 3 is effective in withdrawing the arcuated fingers from the openings 78 in the upper side 58 of the pocket member 52. When the arcuated fingers are moved to the withdrawn position, they permit any newspaper being carried in the pocket member 52 to be released and place the pocket member in readiness to receive another newspaper.

When the actuating lever 80 is caused to move in the direction of the indicating arrow 98 in FIG. 7, the fingers 88 and 90 are lowered so that their rollers 92 and 94, respectively, lose contact with the underside of their respective arcuated fingers 64 and 66. When the arcuated fingers 64 and 66 lose contact with rollers 92 and 94, their respective torsion type springs 72 and 74 are effective in pivoting the fingers in a direction where they re-enter openings 78 to grip and hold the next newspaper received into the pocket member 52.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A conveyor apparatus for successively receiving and retaining single newspapers being independently advanced by a conveyor loading device and independently delivering them to a predetermined location for further processing, said conveyor apparatus comprising:

(a) an endless conveyor track;

(b) a conveyor chain mounted within and for travel about the extent of said endless conveyor track;

(c) a multiplicity of pocket members having walls defining a generally U-shaped configuration operatively connected to said conveyor chain for movement therewith about the exterior surface of said endless conveyor track;

(d) means pivotally mounted on an external surface of a pocket wall and having means extending through said wall to engage single newspapers received from the conveyor loading device;

(e) means biasing said pivotally mounted means toward a position causing a gripping of a newspaper in said pocket (f) actuating means mounted on said pocket and connected to said engaging means for effecting movement thereof to a non-gripping position for releasing a newspaper from said pocket member.

2. The conveyor apparatus according to claim 1, wherein said pocket members are operatively connected to said conveyor chain by a pair of tandem link members.

3. The conveyor apparatus according to claim 1, wherein said engaging means defines a pair of spaced arcuated fingers.

4. The conveyor apparatus according to claim 3, wherein said actuating means defines a cam controlled actuating lever operatively connected to said pair of arcuated fingers for moving the latter in a direction out of engagement with a newspaper and in opposition to the forces of said biasing means.

* * * * *